United States Patent [19]

Danchenko et al.

[11] Patent Number: 4,487,049

[45] Date of Patent: Dec. 11, 1984

[54] WORKING MANDREL AND METHOD OF ROLLING ELONGATE HOLLOW PIECES IN A MULTI-STAND CONTINUOUS MILL ON SAME WORKING MANDREL

[75] Inventors: Valentin N. Danchenko; Alexandr A. Zayats, both of Dnepropetrovsk; Ivan N. Potapov, Moscow; Petr M. Finagin, Moskovskoi; Sergei P. Kutsenko, Dnepropetrovsk, all of U.S.S.R.

[73] Assignee: Dnepropetrovsky Metallurgichesky Institut, Dnepropetrovsk, U.S.S.R.

[21] Appl. No.: 290,009

[22] Filed: Aug. 4, 1981

[51] Int. Cl.[3] ..... B21B 17/04

[52] U.S. Cl. ..... 72/208; 72/479

[58] Field of Search ..... 72/96, 97, 208–209, 72/365, 366, 368, 370, 479; 46/28; 175/19; D15/131, 138

[56] References Cited

U.S. PATENT DOCUMENTS

| | | | |
|---|---|---|---|
| 424,213 | 3/1890 | Kellogg | 72/209 |
| 829,953 | 9/1906 | Dunn | 72/96 |
| 1,837,161 | 8/1930 | Herz | 72/209 |
| 2,239,085 | 4/1941 | Diescher . | |
| 2,384,312 | 9/1945 | Kirchner . | |

FOREIGN PATENT DOCUMENTS

| | | |
|---|---|---|
| 604013 | 9/1934 | Fed. Rep. of Germany . |
| 1752383 | 5/1969 | Fed. Rep. of Germany . |

*Primary Examiner*—Lowell A. Larson
*Assistant Examiner*—Jorji M. Griffin
*Attorney, Agent, or Firm*—Fleit, Jacobson, Cohn & Price

[57] ABSTRACT

A working mandrel is composed of several similar sections, each having a working surface on the body thereof. The leading end of each section has a socket, while the trailing one has a projecting portion of a similar configuration for jointing the sections during the rolling step. Rolling is effected on the working mandrel assembled in a head-to-tail fashion and after the rolling cycle is terminated the leading section is transferred to the mandrel cooling and lubricating line and then, cooled and suitably lubricated, is positioned in front of the first roll stand, while the other sections remain between the first and the last roll stands. Put into position in front of the multistand mill may be a previously prepared section instead of that transferred to the mandrel cooling and lubricating line.

16 Claims, 17 Drawing Figures

WORKING MANDREL AND METHOD OF ROLLING ELONGATE HOLLOW PIECES IN A MULTI-STAND CONTINUOUS MILL ON SAME WORKING MANDREL

BACKGROUND OF THE INVENTION

1. Field of the Invention

The present invention relates to the production of hot-rolled elongate hollow products of both round cross-section, such as seamless pipes, and a cross-sectional configuration other than round on the inner and/or outer contours, such as various ducts or finned tubes. More particularly, this invention relates to a working mandrel and a method of rolling elongate hollow pieces in a multi-stand continuous mill on this working mandrel, which is set to travel at a controlled speed.

The invention contemplates a mandrel for use in continuous rolling mills and made in two parts: a working mandrel whereon a piece is reduced in section and a mandrel bar connected to a drive for axially moving the working mandrel, which is to this effect connected with the bar by a suitable means or bears up against the bar. A mandrel bar associated with such a working mandrel may work in tension as well as in compression. The working mandrel forming the subject of the present invention will hereinafter be termed "a working mandrel of the kind described".

2. Description of the Prior Art

Known in the art is a mandrel of the kind described, which is furnished as part of a multi-stand mill for the production of hot-rolled seamless pipes by INNSE-Innocenti Santeustacchio-Italy, developed in cooperation with Dalmine (both associated with FINSIDER). This mandrel has a working mandrel comprising a body having a working surface, the body being of a cross-sectional configuration corresponding to the inner contour of the piece to be rolled. The working mandrel of the prior art mandrel is up to 13 m long.

In mandrels having such a working mandrel the basic problem involved stems from the length of the mandrel, which length causes difficulties in the manufacture of such mandrels, their transportation, and what is more important, in handling the mandrels, especially in the production of large diameter tubing. Moreover, to manufacture such a working mandrel, special equipment is required. In practice, the working mandrel of such mandrels is known to wear out unevenly on its length and the portion of the working mandrel whereon the piece is reduced in section while it passes the first roll stands, shows a greater amount of wear.

A method of rolling pipes on the above-mentioned mill by utilizing the prior art mandrel is as follows. A cooled and suitably lubricated working mandrel having a groove in its trailing end is gripped by a mandrel drive mechanism arranged at the feed side of the mill. A pierced billet is positioned in front of the first roll stand of the continuous mill. The mandrel is introduced into the pierced billet until its nose extends a predetermined length from the leading end of the billet. The billet is then fed into the first roll stand and is rolled on the working mandrel towards the second and subsequent roll stands. The mandrel travels at a controlled speed so that once the pipe has been fully rolled, the mandrel has travelled up to twice the distance between adjacent roll stands. On the delivery side of the continuous mill there are found delivery pinch rolls for stripping the trailing end of the pipe off the mandrel end as the trailing end of the pipe leaves the mill. After the pipe is stripped off, the mandrel is retracted through all the roll stands into the starting position upstream of the mill from which it is kicked off into the mandrel cooling and lubricating line. A new mandrel, previously cooled and lubricated, is positioned in front of the mill and the rolling cycle is repeated.

The practice of the prior art method involves some difficulties. Thus, for example, time-consuming auxiliary operations, which do not coincide, restrain output for, prior to feeding the next shell, a long mandrel is to be retracted into the starting position upstream of the mill, the working mandrel is to be transferred to the mandrel cooling and lubricating line, and a new working mandrel, cooled and lubricated, is to be delivered into position. The retraction of the mandrel over the rotatable rolls results in an uneven wear of its working surface around the perimeter. Furthermore, as the mandrel is retracted the lubricant is transferred therefrom onto the rolls to result in a lower rolling friction.

SUMMARY OF THE INVENTION

An object of the present invention is to provide a working mandrel of the kind described and a method of rolling elongate hollow pieces in a multi-stand continuous mill allowing an increased output.

A further object of the invention is to provide a working mandrel of the kind described and a method of rolling elongate hollow pieces in a multi-stand continuous mill enabling mandrel handling to be simplified.

A still further object of the invention is to provide a working mandrel of the kind described and a method of rolling elongate hollow pieces in a multi-stand continuous mill making it possible to eliminate uneven wear in the working surface of the mandrel.

Another object of the invention is to provide a lighter in weight and less expensive working mandrel which does not require special machine tools to be manufactured.

Yet another object of the invention is to provide a working mandrel which affords greater diameters or lateral dimensions in seamless pipes and other elongate hollow pieces than it was possible on conventional multi-stand continuous mills.

It is also an object of the invention to provide a working mandrel, which can be manufactured from materials that are of a superior hardness and a more pronounced brittleness than was heretofore possible.

It is among the objects of this invention to provide a working mandrel which can be manufactured by making use of special surface hardening methods, such as explosive hardening.

These and other objects are attained by the provision of a working mandrel of the kind described, comprising a body having a working surface for defining the inner surface of a piece to be rolled, wherein according to the invention the leading end of the body has a socket adapted to loosely receive the mating nose of the compression bar under an axial load during the rolling operation and the trailing end has a portion axially projecting beyond the working surface and being at least partially a counterpart of the socket, the working surface extending along the generating line thereof within the distance between adjacent roll stands.

Such a working mandrel, with two working mandrels of the invention utilized in a two-stand mill, provides for a reduction in the auxiliary time at a sacrifice in the time required for the mandrel to be retracted into the starting position upstream of the mill, since the working mandrel separates from the mandrel bar once a piece has been fully rolled, and then this working mandrel is transferred to the mandrel cooling and lubricating line, while a new working mandrel, cooled and lubricated, is positioned in front of the first roll stand.

To provide for an unobstructed separation of the working mandrel from the mandrel bar, the socket in the leading end thereof, as viewed in the plane of the axial section of the leading end, is desirably a shape defined partially or completely by a concave curve. The socket may also be defined by either conical or frusto-conical surfaces.

For all practical purposes the working surface of the working mandrel is selected to extend along the generating line thereof from 0.25 to 0.95 of the distance between adjacent roll stands. Thus, if the working surface extends beyond 0.95 of the distance specified, it may come in contact with the rotatable rolls to bring about wear of the working surface and the rolls as well. If the surface extension is less than 0.25, then difficulties arise in finding a true position for the working mandrel prior to rolling.

According to another aspect of the invention the working mandrel comprises at least two equally long sections, the leading end of each section having a socket, while the trailing end having a portion axially projecting beyond the working surface, being at least partially a counterpart of the socket, and loosely received in the socket of the adjacent section, the working surface, when the working mandrel is in centerline with the mill during the rolling operation, extending at least the distance between the first and the last roll stands and the distance the leading or first section travels while a single piece is being rolled.

The working mandrel made up of sections that may be loosely jointed as the above implies, provides for an unobstructed separation of these sections once a piece has been fully rolled.

Such an unobstructed separation of the sections of the working mandrel may be effected by providing the trailing end or the projecting portion as well as the corresponding socket in the leading end in the plane of an axial section with such a shape, which is defined partially or completely by a convex curve and a concave curve respectively. Both the projecting portion and the socket may also have a shape defined by a conical or frusto-conical surfaces.

For all practical purposes the working surface of each section is selected to extend along the generating line thereof from 0.25 to 0.95 of the distance between adjacent roll stands as have been described above.

The present invention further consists in the provision of a method of rolling elongate hollow pieces in a multi-stand continuous mill, consisting in that an elongate hollow piece is reduced in section on a working mandrel travelling at a controlled speed in the rolling direction by passing the piece through at least two sets of rolls, then the working mandrel is withdrawn from the rolled hollow piece and transferred to the mandrel preparation line, wherein, according to the invention, utilized are working mandrels the leading end of each of them has a socket adapted to loosely receive the mating nose of the compression bar under an axial load during the rolling operation and the trailing end has a portion axially projecting beyond the working surface and being at least partially a counterpart of the socket, the working surface extending along the generating line thereof within the distance between adjacent roll stands, utilized in the rolling process are as many working mandrels as there are roll stands in the multi-stand continuous mill and prior to feeding a pierced piece into the first roll stand at least one prepared working mandrel is positioned in front of the first roll stand and at least one working mandrel between the first and the last roll stands so that the centerline thereof passes through the bite of the rolls, and reducing the piece in section on a single working mandrel per roll stand, the working mandrel travel being controlled by a backpressure, then, as soon as the rolled hollow piece emerges from the last roll stand, the leading or the first working mandrel is withdrawn from the rolled piece and at least one withdrawn working mandrel is transferred to the mandrel preparation line.

Such a rolling method eliminates the step of retracting the working mandrel into the starting position upstream of the mill, which reduces the auxiliary time and, consequently, increases output.

According to another mode of practicing the invention the withdrawn working mandrel following preparation thereof, i.e., cooling and lubricating, is positioned in front of the first roll stand. Such way of practicing the invention makes use of a minimum number of working mandrels without any interference into the rolling process of the invention or stoppage thereof. In other words, the method of the invention makes it possible to use a mandrel comprising a mandrel bar and several working mandrels during the entire operation of the mill.

A variation of the invention relates to a method of rolling elongate hollow pieces in a multi-stand continuous mill, consisting in that an elongate hollow piece is reduced in section on a working mandrel travelling at a controlled speed in the rolling direction by passing the piece through at least two sets of rolls, then the working mandrel is withdrawn from the rolled hollow piece and transferred to the mandrel preparation line and wherein, according to the invention, a working mandrel is utilized comprising at least as many equally long sections as there are roll stands in the multi-stand continuous mill, the leading end of each section having a socket, while the trailing end having a portion axially projecting beyond the working surface, being at least partially a counterpart of the socket and loosely received in the socket of the adjacent section, the working surface, when the working mandrel is in centerline with the mill during the rolling operation, extending at least the distance between the first and the last roll stands and the distance the leading or first section travels while a single piece is being rolled. Prior to feeding a pierced piece into the first roll stand at least one prepared section of the working mandrel is positioned in front of the first roll stand and at least one section between the first and the last roll stands so that the centerline thereof passes through the bite of the rolls, and reducing the piece in section on a single section of the working mandrel per roll stand, the working mandrel travel being controlled by a backpressure, then, as soon as the rolled hollow piece emerges from the last roll stand, the leading or the first section of the working mandrel is withdrawn from the rolled piece, thereby completing withdrawal of the working mandrel, and at least one withdrawn section of the working mandrel is transferred to the mandrel preparation line.

This variation of the invention is also useful in eliminating the step of retracting the working mandrel into the starting position at the feed side of the mill.

BRIEF DESCRIPTION OF THE DRAWINGS

The invention will now be described, by way of example, with reference to a specific working mandrel and a rolling method with the use of such a working mandrel which are illustrated in the accompanying diagrammatic drawings, in which.

DESCRIPTION OF THE PREFERRED EMBODIMENTS

Since the working mandrel of the invention as well as the rolling method utilizing this working mandrel may be used for the production of elongate hollow pieces of various cross-sectional configuration, the present description will show embodiments of the invention in the production of hot-rolled seamless pipes only, since again, other applications are within the skill of the man of art.

Figure 1:
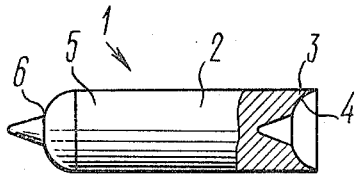
FIG. 1 is a cut-away view of the working mandrel of the invention, showing a socket.

Referring to FIG. 1, the working mandrel comprises a cylindrical body 1 having a working portion or surface 2. The diameter of the body 1 provides a contour of this body, which corresponds to the inner contour and, consequently, to the diameter of the pipe to be rolled. In other words, the rolls and the working mandrel provide a pass for defining a pipe of a desired cross section.

According to the invention the leading end of the working mandrel, an end 3 as exemplified herein, is provided with a socket 4, which is a counterpart of the mating nose of the mandrel bar (not shown) intended to work in compression. The socket 4 (as well as the mandrel bar nose) has a form, which provides for an unobstructed release of the nose from this socket, as illustrated herein this form is a combination of a cone and a hemisphere. The trailing end 5 has a portion 6 projecting beyond the working surface 2. This portion is at least partially a counterpart of the socket 4, but in the embodiment illustrated it completely corresponds to the socket 4, however, serviceability of the working mandrel will not be impaired, if the portion 6 has a herispherical shape only. According to the invention and in conformity with the objects thereof the working surface 2 along its generating line extends within the distance between adjacent roll stands.

Figure 2:
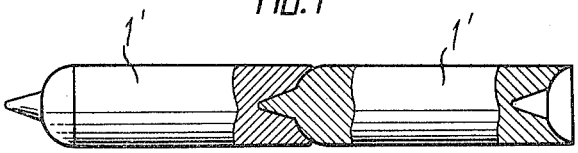
FIG. 2 is an alternative working mandrel constructed according to the invention.

In an alternative embodiment shown in FIG. 2 the working mandrel is made up of two (though more than two are equally possible) bodies or sections 1'. The sections 1' according to this embodiment are equally long and evidently are of equal diameters. Similarly to the first variation of the invention each section 1' has the leading 3 and trailing 5 ends, which in turn have the socket 4 and the projecting portion 6 respectively.

The projecting portion 6 of each section 1' has a shape at least partially corresponding to that of the socket 4. As can be seen in FIG. 2, the sections 1' are butt jointed by loosely introducing the portion 6 into the socket 4 of the adjacent section.

Figure 3:
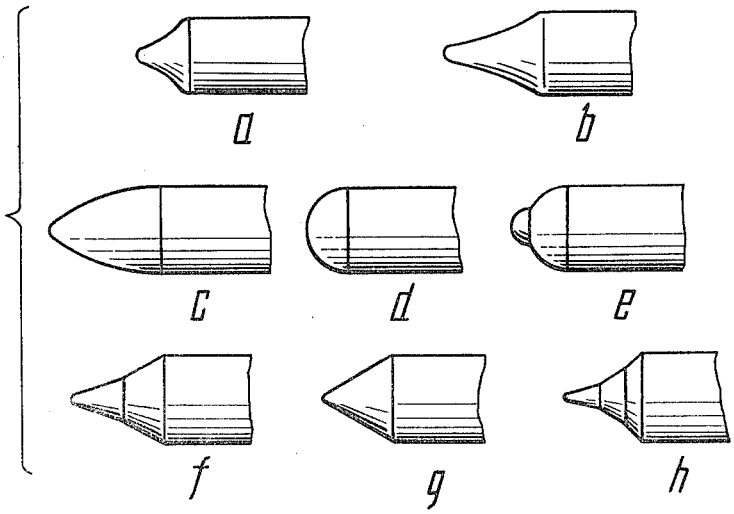
FIGS. 3, *a* through *h*, shows variously modified trailing end of the working mandrel according to the invention.

The shape of the projecting portion and that of the socket in each section is such as to allow an unobstructed release of the projecting portion from the socket of the adjacent section and a similar introduction of the projecting portion into the socket in making up the working mandrel. In the illustrated embodiment the projecting portion 6 has a shape that is a combination of a hemisphere with a cone. However, in both the first and the second variations of the invention the projecting portion 6 and, consequently, the socket 4 may have a shape in the plane of an axial section, which completely or partially is defined by convex and concave curves respectively as shown in FIG. 3, positions *a, b, c,* and *e*. They also may have the shaped defined by a conical or frusto-conical surfaces or by combinations thereof as shown in FIG. 3, positions *f, g* and *h*. It is according with the objects of the invention, if the shapes shown, for example, in FIG. 3, positions *d* and *g*, are combined.

Whereas the working mandrel according to the second variation of the invention comprises the sections 1' having equal lengths, the total length of its working surface along the rolling or mill centerline, when the working mandrel is assembled and a hollow piece is being reduced thereon, is at least equal to the distance between the first and the last roll stands plus the distance the leading or first section travels while a single piece is being rolled.

Tests have shown that the working surface may have an extension or length in both the working mandrel shown in FIG. 1 and in each section of the working mandrel shown in FIG. 2 preferably in the range of 0.25 to 0.95 of the distance between the adjacent roll stands.

The method of rolling elongate hollow pieces in a multi-stand continuous mill, in the example illustrated in a pipe mill for the production of hot-rolled seamless pipes, is as follows.

The rolling operation may be carried out on a mandrel comprising a mandrel bar 7 (FIG. 4) connected to a suitable drive (not shown) to be axially moved therefrom and a working mandrel, which may be made up from several working mandrels of the first variation of the invention or the working mandrel of the second variation of the invention may be used instead. The number of the working mandrels or the sections of the working mandrels depends on the number of roll stands in a mill. If the mill comprises two stands, the rolling may be carried out on two or more working mandrels or a working mandrel consisting of two or more sections.

If the number of roll stands in a mill may increase so may the number of the working mandrels or sections of the working mandrel for use with the mill or may be greater.

Now the method of the invention will be described as used with a two-stand continuous mill.

Figure 4A:
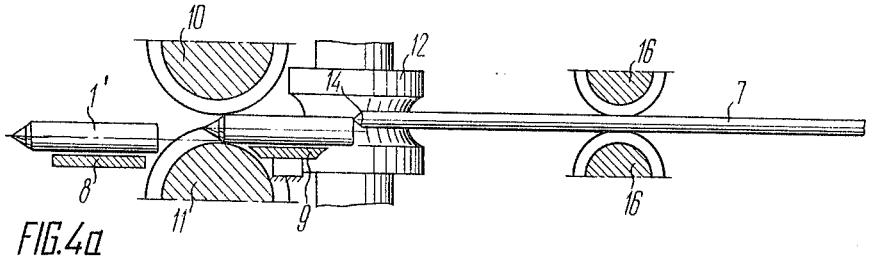
FIGS. 4, *a* through *e*, is a diagrammatic representation of the method according to the invention.
Figure 4B:
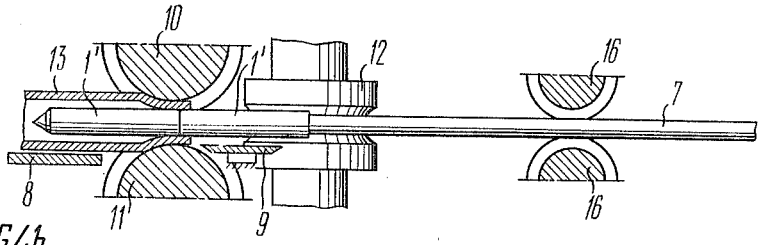
Figure 4C:
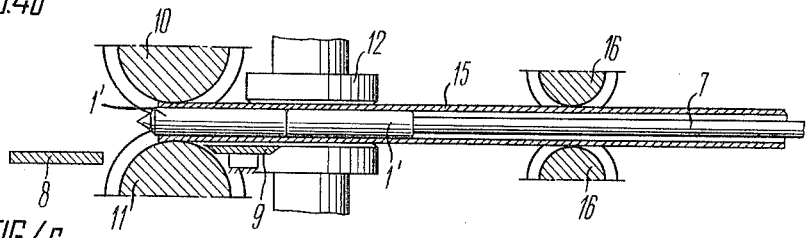
Figure 4D:
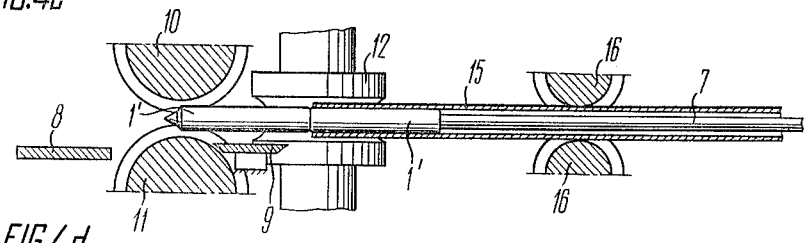
Figure 4E:
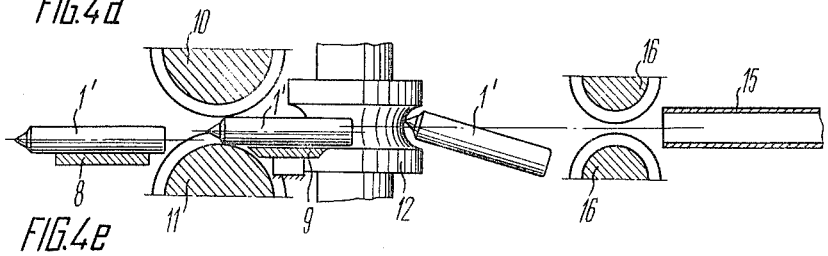

Before the rolling operation begins, prior to or after delivering a hollow piece in position, a working mandrel (FIG. 4*a*) is provided by positioning one working mandrel or section of the working mandrel on the mill entry table at 8 in front of the first stand. Other working mandrels or sections of the working mandrel are arranged on centerline with the mill or in parallel therewith on the guides 9 between the first and the last roll stands so that their centerlines pass through the bite of the rolls as at 10, 11 of the first stand and 12, (the other roll being hidden from view) of the second stand. Now the hollow piece or shell 13 placed in position prior to or after providing the working mandrel, is fed into the rolls 10, 11 of the first stand and the nose 14 of the mandrel bar 7 simultaneously or previously is moved into the socket of the leading working mandrel or section 1' of the working mandrel by pushing the bar in the direction opposite to that of the rolling. The shell 13 having been gripped by the rolls of the first stand, the working mandrels or sections of the working mandrels are arranged coaxially in centerline with the mill due to their jointing at respective sockets 4 and projecting portions 6 and due to backpressure from the mandrel bar 7, thereby providing a rigid sectional mandrel (FIG. 4*b*). The shell 13 is rolled into pipe 15 between the rolls 10, 11 and 12, (the other roll being hidden from view) and on the mandrel provided according to the invention from working mandrels or sections 1' of the working mandrel and from the mandrel bar 7 floating in the direction of rolling at a predetermined speed, which is slower than that of the rolling operation and is controlled by a suitable drive (not shown), thereby providing backpressure in the mandrel centerline i.e., the mandrel moves at a controlled speed. As the shell 13 is being rolled the metal thereof is being pressed by the rolls and the length of the tube is increased due to a difference between the rolling speed and that of the mandrel, which travels into position c of FIG. 4. As the rolling operation continues the mandrel and the pipe 15 that have been already rolled take position d of FIG. 4 as a result of the predetermined speed ratio of the rolls and the mandrel, which is recognized by those versed in the art of rolling.

At this instance rolling is completed and withdrawal of the leading working mandrel or leading section of the working mandrel by delivery pinch rolls 16 begins. Similar working mandrels or sections of the working mandrel, which follow the leading one are shown on the diagrammatic representation of this instant method of rolling (FIG. 4) to be cleared of the pipe 15 before and remain between the roll stands on the guides 9. After the pipe 15 is stripped off the leading working mandrel or section of the working mandrel, the latter is unobstructed to separate from the adjacent working mandrel or section of the working mandrel, with which it was jointed during rolling (FIG. 4, position e), and it is transferred into the mandrel preparation line wherein it is let to cool or it is cooled and lubricated. This working mandrel or section of the working mandrel being cooled and lubricated is positioned in front of the first roll stand and the rolling operation on another shell is repeated.

This method of rolling provides for a substantial reduction in auxiliary time owing to the mandrel retraction being unnecessary. In the method of the invention the working mandrel travels in the rolling direction at all times and substantially continuously i.e., in operation there is an arrangement which may be termed an endless mandrel. The auxiliary time may be further reduced, if more than two working mandrels or sections of the working mandrel are used simultaneously in a two-stand mill and for other multi-stand mills respectively. In such a case a cooled and lubricated working mandrel or section of the working mandrel may be positioned at the same time as the leading working mandrel or section of the working mandrel is withdrawn.

As can be seen in FIG. 4 the shell in each stand is reduced on a single or individual section of the working mandrel. In other words, as a single piece is rolled each working mandrel or section of the working mandrel covers a distance not exceeding the length of the working mandrel along the generating line. This operation in practicing the method according to the invention is a result of the dimensions claimed and by suitably controlling the rate of travel of the mandrel.

Now examples of practicing the method of the invention when the above condition is not met will be discussed.

Figure 5A:
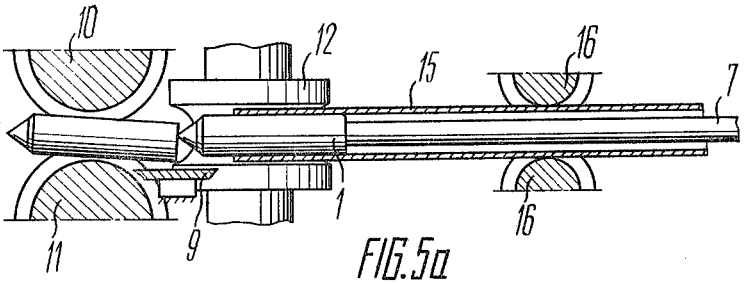
FIG. 5 is an illustration of negative examples of practicing the method according to the invention, wherein position 5*a* is an instance when the working mandrel travels a distance shorter than its length and position 5*b* is an instance when the working mandrel travels a distance longer than its length.

If over a period of time a single piece was rolled the working mandrel or section of the working mandrel travels a distance that is shorter than the length of the working mandrel or section of the working mandrel, then by the end of the rolling operation there is a situation illustrated in FIG. 5*a*, i.e., the working mandrels or sections of the working mandrel do not pass c[illegible] of the roll bite. In this case the working mandrel or section of the working mandrel that follows the leading one will beat on the revolving rolls and in preparation for the next rolling cycle it is to be set in position manually, which is a tough job as regards the weight of the working mandrels or sections of the working mandrel.

Figure 5B:
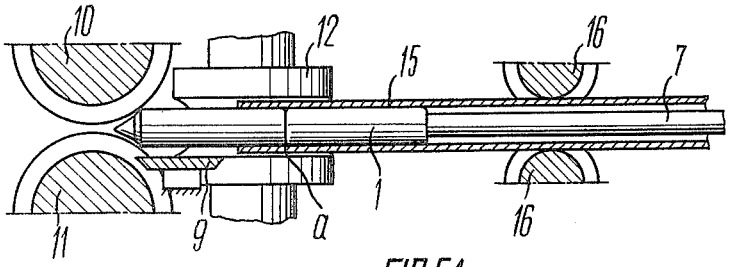

If the working mandrel or section of the working mandrel travels a distance that is longer than the length thereof the shell 13 and a semifinished pipe are reduced in section on the joint of adjacent working mandrels or sections of the working mandrel, which results in an annular bulge on the inner surface of the pipe as at a of FIG. 5*b*, and in that the working mandrel or section of the working mandrel happen to be out of position prior to the next rolling cycle. In this case a section of the pipe that has been rolled has to be discarded and the working mandrel or section of the working mandrel has to be put in position as in the case shown in position FIG. 5*a*.

As have been hereinbefore disclosed the method of producing elongate hollow pieces in a multi-stand continuous mill on the working mandrel of the invention provides for a reduction in auxiliary time through simultaneous transferring of the working mandrel into the mandrel preparation line and positioning thereof in front of the mill and, consequently, for an increased output.

Inasmuch as the working mandrels of the invention are at most one half as long as those now in use, handling and manufacture thereof, especially from materials of superior hardness and more pronounced brittleness, are simplified.

As disclosed herein and shown in the accompanying drawings the shell is reduced on each working mandrel or section of the working mandrel successively in all the stands of the mill to make wear on the working surface more even.

Since the working mandrels or sections of the working mandrel of the invention are shorter the lower is their weight which makes it possible to increase their diameter to produce pipes of an increased internal diameter size.

Reduction in dimensions of the working mandrel of the invention as compared with the prior art mandrels allows special methods of surface hardening to be used in the manufacture of such working mandrels, such methods as explosive face hardening.

While the invention has been described herein in terms of pipe rolling, numerous variations apparent to those skilled in the art, such as rolling elongate hollow pieces other than round in section, may be made herein within the spirit and scope of the invention as defined in the claims.

What is claimed is:

1. A working mandrel for a multi-stand rolling mill, said working mandrel comprising:

a body having a working surface for defining the inner surface of a piece to be rolled, a leading end, and a trailing end;

the leading end of said body having a socket adapted to loosely receive a mating nose of a compression bar under an axial load during the rolling operation;

the trailing end of said body having a portion axially projecting beyond the working surface and being at least partially a counter part of the socket in the leading end of said body;

the working surface, when the working mandrel is in centerline with a multi-stand rolling mill during the rolling operation, extending less than the distance between adjacent roll stands.

2. A working mandrel as set forth in claim 1, wherein the socket, as viewed in the plane of the axial section of the leading end, is a shape defined at least by a concave curve.

3. A working mandrel as set forth in claim 1, wherein the socket, as viewed in the plane of the axial section of the leading end, is a shape defined by a concave curve.

4. A working mandrel as set forth in claim 1, wherein at least a part of the socket in the leading end is defined by a frusto-conical surface.

5. A working mandrel as set forth in claim 1, wherein the socket in the leading end is defined by a conical surface.

6. A working mandrel as set forth in claim 1, wherein the working surface extends along the generating line thereof from 0.25 to 0.95 of the distance between adjacent roll stands.

7. A working mandrel comprising:

a mandrel bar;

a body having a working surface for defining the inner surface of a piece to be rolled and comprising at least two equally long sections, one of which engages with said mandrel bar;

each said section having a leading end wherein a socket is provided and a trailing end having a portion axially projecting beyond the working surface being at least partially a counterpart of the socket and loosely received into the socket of the adjacent section;

the working surface, when the working mandrel is in centerline with a multi-stand rolling mill during the rolling operation, extending at least the distance between the first and the last roll stands and the distance the leading section travels while a single piece is being rolled.

8. A working mandrel as set forth in claim 7, wherein the projecting portion of the trailing end of each section, as viewed in axial section, is a shape defined at least by a convex curve.

9. A working mandrel as set forth in claim 7, wherein the projecting portion of the trailing end of each section, as viewed in axial section, is a shape defined by a convex curve.

10. A working mandrel as set forth in claim 7, wherein at least a part of the projecting portion of the trailing end of each section is defined by a frusto-conical surface.

11. A working mandrel as set forth in claim 7, wherein the projecting portion of the trailing end of each section is defined by a conical surface.

12. A working mandrel as set forth in claim 7, wherein the working surface of each section extends along the generating line thereof from 0.25 to 0.95 of the distance between adjacent roll stands.

13. A method of rolling elongate hollow pieces in a multi-stand continuous mill, comprising the steps of:

positioning an elongate hollow piece in front of the rolling mill comprising at least two roll stands;

providing a mandrel comprising a mandrel bar and at least as many working mandrel sections as there are roll stands in the multi-stand continuous mill, each working mandrel section having a working surface of a length less than the distance between adjacent roll stands, a socket in the leading end thereof, and a portion axially projecting beyond the working surface on the trailing end thereof, the projecting portion being at least partially a counterpart of the socket on the leading end and being loosely received in the socket of the adjacent working mandrel section, by positioning at least one prepared working mandrel section in front of the first roll stand and at least one between the first and the last roll stands and by moving the nose of the mandrel bar into the socket of the leading working mandrel section;

feeding said elongate hollow piece into the first roll stand;

rolling said elongate hollow piece by reducing it in section on a single working mandrel section per roll stand, the working mandrel section travel being controlled by a backpressure exerted by said mandrel bar;

withdrawing the leading working mandrel section of said mandrel from the rolled hollow piece after the rolling step; and transferring at least one withdrawn working mandrel section to a mandrel preparation line.

14. A method as set forth in claim 13, wherein at least one withdrawn working mandrel section is positioned in front of the first roll stand following preparation thereof.

15. A method of rolling elongate hollow pieces in a multi-stand continuous mill, comprising the steps of:

positioning an elongate hollow piece in front of the rolling mill comprising at least two roll stands;

providing a mandrel comprising a mandrel bar and a working mandrel comprising at least as many equally long sections as there are roll stands in the multi-stand continuous mill and having a working surface, when the working mandrel is in centerline with the mill during the rolling operation, extending at least the distance between the first and the last roll stands and the distance the leading section travels, while a single piece is being rolled, each section having a socket in the leading end thereof and a portion axially projecting beyond the working surface on the trailing end thereof, the projecting portion being at least partially a counterpart of the socket on the leading end and being loosely received in the socket of the adjacent section, by positioning at least one prepared section of the working mandrel of said mandrel in front of the first roll stand and at least one between the first and the last roll stands and by moving the nose of the mandrel bar into the socket of the leading working mandrel;

feeding said elongate hollow piece into the first roll stand, then rolling said elongate hollow piece by reducing it in section on a single section of the working mandrel of said mandrel per roll stand, the section travel being controlled by a backpressure exerted by said mandrel bar;

withdrawing the leading section of the working mandrel of said mandrel from the rolled hollow piece after the step of rolling and transferring at least one withdrawn section to a mandrel preparation line.

16. A method as set forth in claim 15, wherein at least one withdrawn section of the working mandrel is positioned in front of the first roll stand following preparation thereof.

* * * * *